United States Patent [19]

Altemose

[11] Patent Number: 4,482,065

[45] Date of Patent: Nov. 13, 1984

[54] BOTTLE RACK

[75] Inventor: James L. Altemose, Malvern, Pa.

[73] Assignee: Creative Environments, Inc., King of Prussia, Pa.

[21] Appl. No.: 425,554

[22] Filed: Sep. 28, 1982

Related U.S. Application Data

[63] Continuation of Ser. No. 222,994, Jan. 6, 1981.

[51] Int. Cl.[3] ..... B01D 33/00

[52] U.S. Cl. ..... 211/74

[58] Field of Search ..... 211/74, 41, 189, 81; D6/188; D7/71; 248/220.3; 206/427, 421

[56] References Cited

U.S. PATENT DOCUMENTS

| | | | |
|---|---|---|---|
| 2,100,421 | 11/1937 | Wupper | 248/220.3 |
| 2,338,310 | 1/1944 | Barnes | 211/189 |

FOREIGN PATENT DOCUMENTS

| | | | |
|---|---|---|---|
| 1490656 | 6/1967 | France | D7/71 |
| 1846 | of 1867 | United Kingdom | 211/74 |
| 2384 | of 1872 | United Kingdom | 211/74 |

OTHER PUBLICATIONS

Housewares Review, p. 50, Jan. 1969.
Design, p. 22, Jul. 1978.
House & Garden, p. 209, Nov. 1971.

*Primary Examiner*—William H. Schultz
*Assistant Examiner*—Ramon O. Ramirez
*Attorney, Agent, or Firm*—Thorpe, North & Western

[57] ABSTRACT

A bottle rack for compactly storing and displaying narrow-neck bottles in an easily accessible manner. An upright panel has a plurality of holes passing therethrough. The holes are sized to receive the neck of a bottle inserted therein. Below each hole is a pair of spaced-apart support pegs that transversely protrude out from the panel so as to support the weight of the bottle. The support pegs are spaced apart a distance less than the body diameter of the smallest bottle to be stored or displayed in the rack. The holes are spaced apart approximately the same distance as the largest diameter of the bottle bodies. The holes are also arranged in a desired pattern, such as rows and columns, so that the bottles may be stored in an orderly fashion. In one embodiment, the support pegs protrude out from both sides of the panel and, accordingly, bottles may be inserted into the rack from either side of the panel. The support pegs prevent undesirable lateral movement of the bottles and also allow sufficient visability to enable the bottle labels to be easily read. Support structure is used to hold the panel in its upright, generally vertical, position. A cabinet may be built around the panel having doors that allow access into the rack area from either side of the panel.

9 Claims, 3 Drawing Figures

BOTTLE RACK

This application is a continuation of application Ser. No. 222,994, filed Jan. 6, 1981.

BACKGROUND OF THE INVENTION

This invention relates to a bottle holding rack, primarily intended for holding wine bottles, but which can be used for holding many other types of bottles.

Bottle racks are known in the prior art that employ an upright member having holes adapted to receive the necks of the bottles which are to be held therein. See, e.g., Barnes, U.S. Pat. No. 2,155,884 (1939); Barnes, U.S. Pat. No. 2,338,310 (1944); Leventhal, U.S. Pat. No. Des. 250,625 (1978); and Lyons, U.S. Pat. No. Des. 255,520 (1980).

Numerous problems are associated with these type of prior art bottle racks. One of the main problems is that the bottles stored therein require very strong necks. This is because the full weight of the bottle must be supported from its neck.

Another problem associated with the above racks is that the angle at which the bottle slopes from the upright member will be dependant upon the size and shape of the bottle. This not only creates a sloppy appearance in how the bottles are maintained in the rack, but it also makes it difficult to: (1) read the labels of the various bottles and (2) easily remove or insert bottles into desired locations. Furthermore, because the angle of the bottle slope will not be uniform, the available storage density (number of bottles that can be stored per square foot of the upright member) is not optimized.

An additional problem associated with sloping the upright member or sloping the holes in the upright member is that bottles can only be inserted into the upright member from one side. While it is true that two upright members can be placed back-to-back, as disclosed in the Barnes '310 patent, this type of arrangement does not lend itself to an efficient use of available storage space.

SUMMARY OF THE INVENTION

A principal object of the present invention is to provide an improved bottle rack that neatly stores and displays a wide variety of bottle shapes and sizes without placing the weight of the bottle on the bottle's neck.

A further object of the present invention is to provide such a bottle rack that can store and display either empty or full bottles.

Another object of the present invention is to provide such a bottle rack wherein the bottles are held secure and cannot be inadvertently knocked out of the rack or otherwise caused to laterally move in an undesirable fashion.

An additional object of the present invention is to provide a bottle rack that permits high bottle storage density while maintaining easy label readability.

Still a further object of the present invention is to provide such a bottle rack that allows bottles to be stored and displayed in a neat, orderly and aesthetically pleasing fashion.

Still an additional object of the present invention, in one embodiment thereof, is to provide such a bottle rack that permits bottles to be stored from either side thereof.

Another object of the invention is to provide a bottle rack that is easy to manufacture and assemble.

The above and other objects of the present invention are realized in an illustrative embodiment that includes an upright panel having a plurality of holes passing therethrough. The holes are typically arranged compactly in a desired pattern, such as rows and columns, and are sized so as to receive the necks of bottles inserted therein. Below each of the holes is a pair of spaced-apart support pegs that transversely protrude out from the upright panel so as to support the weight of the bottle. These support pegs are spaced apart a distance that is less than the body diameter of the smallest bottle to be held therein, thereby preventing such bottle from falling therebetween.

The holes into which the necks of the bottles are inserted may be spaced apart a distance that is only slightly greater than the body diameter of the largest bottle to be held by the rack. Thus, the bottles can be inserted into the rack so as to be almost touching each other, or may be spaced further apart as desired.

In one embodiment of the invention, the support pegs protrude out from both sides of the upright panel. This two-sided arrangement allows bottles to be inserted into the rack from either side of the panel. When a two-sided rack is employed in this fashion, the holes may be arranged in a honeycomb arrangement such that more bottles may be held on the two sides of the board than could fit on either side alone. Accordingly, still another embodiment of the invention includes support pegs protruding out from every other hole on one side of the upright panel. The holes that do not have support pegs as viewed from one side of the panel do have the pegs when viewed from the other side of the panel.

A suitable support structure is used to hold the panel in a general upright vertical position. The bottles are thus displayed and stored in an orderly fashion regardless of the size of the bottles and regardless of whether the bottles are full or empty. Moreover, the use of pegs to support the weight of the bottles interferes little or not at all with the readability of the bottle labels. Furthermore, because a pair of support pegs are used for each bottle, and the bottle drops between these pegs to a certain extent, any undesirable lateral movement of the bottles is checked. Thus, the bottles, if bumped, will not fall out of the structure since the board surrounding the neck of the bottle restrains the extent of its lateral movement by the same principle that has been used in the prior art to support bottles by their necks against gravity.

BRIEF DESCRIPTIONS OF THE DRAWINGS

The above and other objects, features, and advantages of the invention will be more apparent from the following more particular description presented in connection with the accompanying drawings in which.

DESCRIPTION OF THE PREFERRED EMBODIMENT

The invention herein disclosed is best understood by reference to the figures wherein like parts are designated with like numerals throughout.

Figure 1:
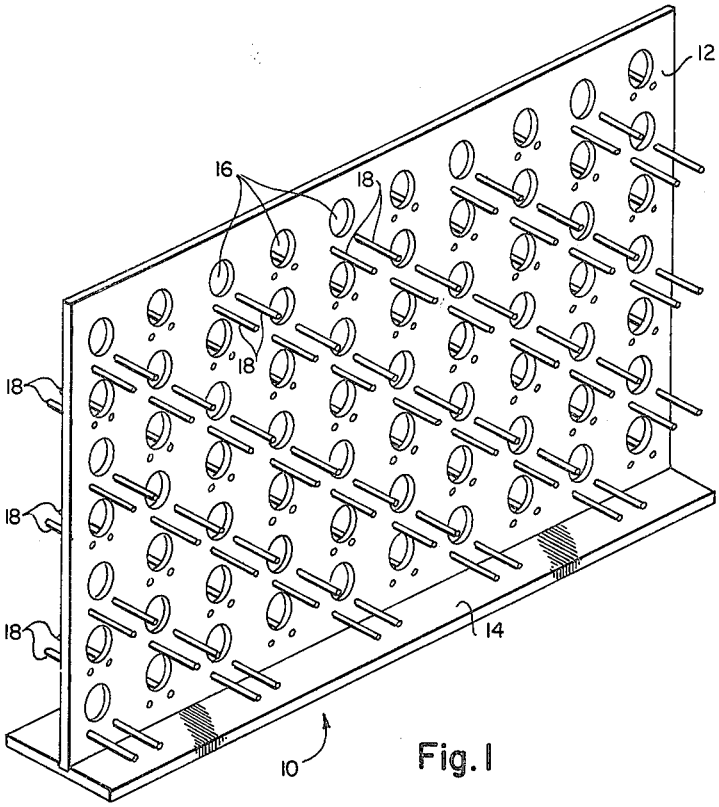
FIG. 1 is a perspective view of an empty bottle rack built in accordance with the principles of the present invention.

Referring first to FIG. 1, there is shown a perspective view of a bottle rack 10 built in accordance with the principles of the present invention. A panel 12 is held in an upright position by a base 14. The panel 12 has a plurality of holes 16 located therein. These holes 16 will typically be arranged in a desired pattern, such as the rows and columns as depicted in FIG. 1. Below each hole 16 there exists a pair of spaced-apart pegs 18 that transversely protrude out from the panel 12. As will be explained more fully below, these holes 16 are each adapted to receive the neck of a bottle 26 (FIG. 2) and the pair of spaced-apart pegs 18 are adapted to support the weight of the bottle 20.

Figure 3:
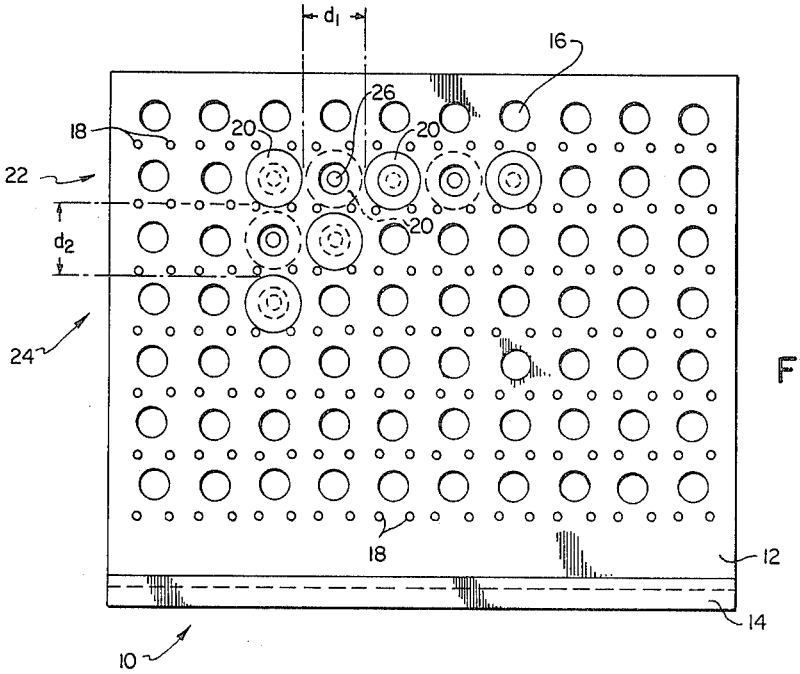
FIG. 3 is a side view taken along the line 3—3 of FIG. 2.

Advantageously, the pair of spaced-apart pegs 18 may protrude out from the panel 12 on both sides thereof. Thus, the bottles 20 may be inserted into the rack 10 from either side. Inasmuch as only the neck of one bottle 20 may be received by a hole 16 at any given time, the preferred embodiment of the invention contemplates that the spaced-apart pegs 18 alternately protrude out from opposite sides of the panel 12 along any given row or column of holes. Thus, as shown best in FIG. 3, the bottles 20 stored on one side of the rack 10 will not be immediately adjacent to each other. That is, as illustrated in FIG. 3, bottles inserted into the rack 10 from the front side (that side shown in FIG. 3) would only be inserted into the first, third, fifth, seventh, and other odd numbered holes along the second row of holes, as shown at 22 in FIG. 3 (assuming the holes are numbered from left to right). Similarly, bottles could be inserted into the even numbered holes (that is the second, fourth, sixth, and so on, these holes still being numbered from left to right as viewed from the front side shown in FIG. 3) along this same second row 22 from the back side of the rack 10. The third row of holes, shown at 24 in FIG. 3, would be just the opposite of the second row of holes. That is, the bottles 20 would be inserted into the second, fourth, sixth, and so on, even numbered holes from the front side of the rack 10. Bottles would be inserted into the rack 10 from the rear side in the first, third, fifth, and so on, holes of this same row. The placement of the spaced-apart support pegs 18 would determine from which side of the rack 12 the bottles were to be placed. Alternately, support pegs may be arranged to protrude from a single side of the board for each hole where it is desired to use a single-side board.

Figure 2:
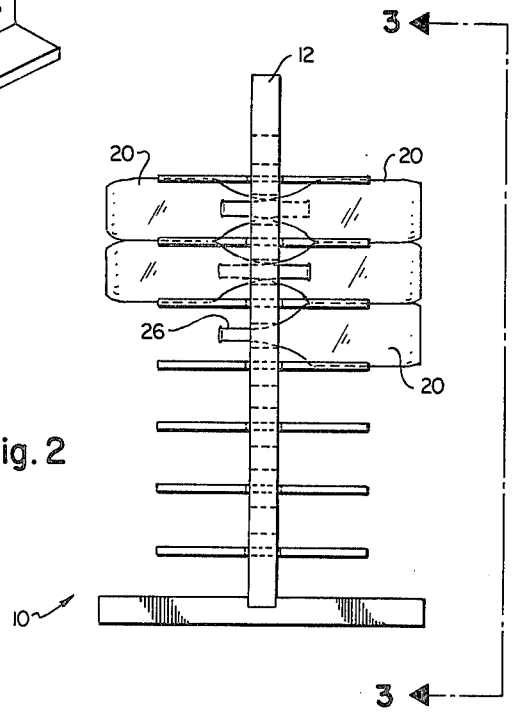
FIG. 2 is an end view of a bottle rack as in FIG. 1, except that some bottles are shown loaded therein.

The invention contemplates a rack into which bottles may be inserted only from one side thereof (spaced-apart support pegs protruding out from only one side) and also a rack into which bottles may be inserted into any hole from either side thereof (spaced-apart support pegs protruding out in both directions from the same hole). However, the preferred embodiment above described, wherein the bottles may only be inserted into every other hole along a given row, or other pattern of holes, from the same side, provides several significant advantages. In this preferred embodiment, there remains a horizontal space $d_1$ between adjacent bottles 20 along the same row. Similarly, there remains a vertical space $d_2$ between adjacent bottles along any given column. Only the neck 26 of a bottle 20 inserted into the opposite side of the rack lies between adjacent bottles 20 inserted into the other side of the rack. And, of course, the neck 26 of the bottles 20 does not protrude through to the opposite side of the rack 10 a very significant distance (as best shown in FIG. 2). These spaces $d_1$ and $d_2$ allow adequate visibility so that the labels of the bottles 20 may be readily read. This visibility of the labels can be a significant advantage where a large number of wine bottles, for example, of numerous varieties and types are held and displayed within the same rack 10.

As briefly mentioned above, the pair of spaced-apart support pegs 18, in addition to supporting the weight of the bottle 20, also serve to maintain the bottle in its desired storage position. This desired storage position is generally to have the longitudinal axis of the bottle 20 approximately perpendicular to the plane of the panel 12. By spacing the pair of pegs 18 a proper distance apart, the bottle 20 will rest therebetween and significant lateral movement of the bottle will be retarded. Further lateral movement such as would dislodge a bottle from the pegs is blocked by the perimeter of the holes through which the necks of the bottles protrude. Thus, the bottles 20 are quite secure in their storage position.

When the holes 16 are arranged in a desired pattern, such as the rows and columns pattern shown in the figures, the bottle rack 10 not only becomes an efficient storage rack, but it also becomes an attractive display rack. That is, the bottles 20 are always maintained in straight lines or columns (or other suitable patterns depending upon the locations of the holes) regardless of a variety of different bottle shapes, and the bottles will always remain generally orthogonal to the upright panel 12. Thus, the bottle rack 10 is ideally suited for restaurants, clubs, and the like where a large variety of beverages are stored and need to be readily accessible for serving to the patrons. For security and for temperature control the entire rack 10 could be enclosed within a suitable cabinet. The doors of the cabinet could allow access to either side of the rack. Moreover, the doors and sides of the cabinet could be made from glass so that the display aspects of the rack 10 would not be hidden. Furthermore, if the beverages contained in the bottles 20 need to be refrigerated, the cabinet may act as a refrigeration compartment.

For typical wine bottles, the preferred size of the hole 16 is approximately $1\frac{1}{2}$ inches in diameter. However, diameters of between $1\frac{1}{4}$ to 2 inches are suitable. If champagne bottles are to also be placed on the same rack with other wines, the holes are preferably between $1\frac{1}{2}$ and 2 inches in diameter, since the neck of a typical champagne bottle is approximately $1\frac{1}{2}$ inches. The important criteria is that the size of the hole be sufficiently large to allow the neck 26 of the bottle 20 to readily pass therethrough. The hole 16 needs to be sufficiently small, however, so that the bottle 20 is constrained in the lateral movement so as not to be knocked from the rack.

The spacing of the holes is also important if efficient storage and display of the bottles is to be realized. In a preferred embodiment, the spacing between centers of adjacent holes is approximately equal to the largest diameter of the bottles to be stored, one advantage of the two-sided arrangement shown in FIG. 3, where bottles are only inserted into alternate holes on any one side of the rack 10, is that the spacing between adjacent holes can actually be significantly less than the diameter of the bottles 20, thereby increasing storage efficiency. A suitable spacing for the holes 16 for use with wine (including champagne) bottles has been determined to be approximately 3 inches on center.

The distance between the pegs of the spaced-apart pair of pegs 18 is also important. This distance needs to be large enough so that the bottles 20 will be secure when rested therebetween, yet small enough so that the bottle will not completely fall therethrough. A good spacing has been found to be approximately 2 inches.

The pegs 18 may advantageously be realized using round dowels. Any suitable size dowel could be used, although the preferred embodiment employs dowels having a diameter of 7/16 inch. This choice is largely aesthetic and a matter of the strength of the material used.

The dowels or pegs 18 are secured to the upright panel 12 by merely inserting them into a hole that has been previously drilled therein. In the preferred embodiment, the holes for the dowels 18 are drilled in the panel 12 so as to pass completely therethrough. This greatly simplifies the manufacture and construction of the rack 10. The dowels 18 are merely inserted into these previously drilled holes and allowed to protrude a short distance out from the hole on the back side of the panel 12. (The "back" side being defined, for purposes here, as that side opposite the side from which the bottle is inserted into the rack.) Typically, the dowels 18 protrude out from the front side of the panel 12 a distance of between 5 and 10 inches. This distance largely depends upon the size of the bottles that will be used and stored in the rack. Where the panel 12 is realized using a board that is approximately 1 inch thick, a dowel that is approximately $8\frac{1}{2}$ inches long has been found to be suitable for holding wine bottles. This means that the dowel actually protrudes out from the panel 12 a distance of between 7.0 to 7.5 inches, depending upon how far the dowel is allowed to protrude out from the back side of the panel 12.

The base 14 may be realized using a suitable 1 inch thick board. A dado joint may advantageously be used to connect the panel 12 to the base 14. Of course, other suitable materials could be used to realize the base 14, the panel 12, or the pegs 18, other than those mentioned herein.

In order to make the rack 19 more aesthetically pleasing, it would also be possible to scroll an attractive design around the edge of or upon the panel 12 without being significantly obscured, particularly when the rack is empty. Furthermore, as mentioned above, the holes 16 themselves could be arranged in an attractive design (other than simple rows and columns) so as to give the rack 10 a pleasing appearance.

As described above, the bottle rack 10 is extremely simple to manufacture and assemble. All that is required is panel 12 into which two sizes of holes are drilled in a desired pattern. The holes 16, for receiving the necks of the bottles, would be drilled having one size. Additional holes, adapted to receive the pegs 18, would also be drilled having a smaller size. Once these holes were drilled, all that need be done is to cut the dowels 18 to a suitable length. For shipping, the panel 12, the base 14, and the unattached pegs or dowels 18 could be conveniently and efficiently packaged in a suitable shipping container. Upon arrival at their destination, assembly would be very simple. All that would need to be done is to insert the dowels 18 into their respective holes, and fasten the panel 12 to the base 14. Such assembly could be quickly accomplished without the need of any special tools or complicated instructions.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

What is claimed is:

1. A bottle rack adapted to receive bottles for displaying and storing comprising:

a panel having a plurality of holes arranged generally in rows and columns for receiving the necks of bottles and for restraining movement of the bottles through the holes;

a pair of spaced-apart pegs protruding outwardly from said panel below each of said holes, with the spaced-apart pegs associated with consecutively adjacent holes along both the rows and columns alternately protruding out from opposite sides of the panel, each of said pair of pegs being spaced apart a distance less than the diameter of the bottles and being further spaced below the center of said each hole a sufficient distance to allow the bodies of the bottles to rest thereon when the necks of the bottles are inserted in said each hole; and support structure for holding said panel in a generally vertical plane.

2. A bottle rack as defined in claim 1 wherein the vertical spacing between the centers of said holes in said columns is approximately the same as the horizontal spacing between the centers of said holes in said rows.

3. A bottle rack as defined in claim 1 wherein the distance between said pegs of said pair of spaced-apart pegs is approximately 2 inches.

4. A bottle rack as defined in claim 3 wherein said holes have a diameter of between 1.2 to 2.0 inches.

5. A bottle rack as defined in claim 4 wherein the horizontal distance between the centers of said holes is between 2.6 to 3.2 inches.

6. A bottle rack as defined in claim 5 wherein said pegs protrude out from said panel at least 5.0 inches and not more than 10.0 inches.

7. A bottle rack as defined in claim 6 wherein said pegs comprise round dowels.

8. A bottle rack as defined in claim 1 wherein each pair of said spaced-apart pegs below a given row of holes transversely protrudes out from said panel from a horizontal line that lies below the center of said holes a distance that is approximately one half the vertical distance between the centers of said holes.

9. A method of compactly storing and displaying narrow neck bottles, such as wine bottles, comprising the steps of:

(a) supporting a panel in a generally vertical plane, said panel having a plurality of holes passing therethrough of sufficiently large diameter to receive the necks of said narrow neck bottles and of sufficiently small diameter to restrain said bottles against horizontal motion of sufficient magnitude to dislodge said bottles from storage, said holes being arranged generally in rows and columns;

(b) placing a pair of spaced-support pegs below each of said holes so that the pegs associated with consecutively adjacent holes along both the rows and columns alternately protrude out from opposite sides of the panel, each of said pair of pegs being spaced apart a distance that is less than the diameter of said narrow-neck bottles, each of said pair of pegs being further spaced below the center of the corresponding hole a sufficient distance so as to allow the body of a bottle to rest thereon when the neck of the bottle has been inserted into the hole; and (c) inserting the bottles to be stored and displayed into respective holes of said panel, the necks of said bottles passing through said holes and the bodies of said bottles resting upon said spaced-apart support pegs.

* * * * *